US011721908B2

(12) United States Patent
Chou

(10) Patent No.: US 11,721,908 B2
(45) Date of Patent: Aug. 8, 2023

(54) ANTENNA STRUCTURE WITH WIDE BEAMWIDTH

(71) Applicant: Wistron NeWeb Corp., Hsinchu (TW)

(72) Inventor: Keng-Hung Chou, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 157 days.

(21) Appl. No.: 17/372,786

(22) Filed: Jul. 12, 2021

(65) Prior Publication Data

US 2022/0209416 A1 Jun. 30, 2022

(30) Foreign Application Priority Data

Dec. 31, 2020 (TW) ..... 109147077

(51) Int. Cl.
*H01Q 13/10* (2006.01)
*H01Q 1/48* (2006.01)

(52) U.S. Cl.
CPC ..... *H01Q 13/10* (2013.01); *H01Q 1/48* (2013.01)

(58) Field of Classification Search
CPC .. H01Q 13/10; H01Q 13/206; H01Q 21/0075; H01Q 21/065; H01Q 9/0407; H01Q 1/38
See application file for complete search history.

(56) References Cited

U.S. PATENT DOCUMENTS 4,180,817 A * 12/1979 Sanford ..... H01Q 25/004 343/700 MS
4,291,312 A * 9/1981 Kaloi ..... H01Q 21/065 343/700 MS
6,967,620 B2 11/2005 Ryken, Jr. et al.
7,839,350 B2 * 11/2010 Nagai ..... H01Q 9/045 343/851
7,920,094 B2 * 4/2011 Hansen ..... H01Q 9/045 343/810
11,201,381 B1 * 12/2021 Mruk ..... H01Q 21/0006
(Continued)

FOREIGN PATENT DOCUMENTS

CN 107154530 A 9/2017
JP S59-122204 A 7/1984
(Continued)

*Primary Examiner* — Ricardo I Magallanes
(74) *Attorney, Agent, or Firm* — McClure, Qualey & Rodack, LLP

(57) ABSTRACT

An antenna structure with a wide beamwidth includes a dielectric substrate, a ground plane, a first radiation element, a plurality of first conductive via elements, and a first feeding connection element. The dielectric substrate has a first surface and a second surface which are opposite to each other. The ground plane is disposed on the second surface of the dielectric substrate. The first radiation element is disposed on the first surface of the dielectric substrate. A first notch is formed on the first radiation element. The first conductive via elements penetrate the dielectric substrate. The first conductive via elements are coupled between the first radiation element and the ground plane. The first feeding connection element is coupled to the first radiation element. The first feeding connection element extends into the first notch of the first radiation element.

16 Claims, 11 Drawing Sheets

(56) References Cited

U.S. PATENT DOCUMENTS

2008/0129408 A1* 6/2008 Nagaishi ..... H01P 5/107 333/32
2013/0027240 A1* 1/2013 Chowdhury ..... G01S 13/345 342/175
2014/0145909 A1* 5/2014 Chen ..... H01Q 21/08 343/893
2015/0029072 A1* 1/2015 Huang ..... H01P 5/12 333/128
2015/0346322 A1* 12/2015 Schmalenberg ..... H01Q 13/206 342/175
2016/0336654 A1* 11/2016 Aoki ..... H01P 3/121
2017/0324143 A1* 11/2017 Talty ..... H01Q 1/1271
2018/0027647 A1* 1/2018 Rengarajan ..... G01S 7/03 342/175
2018/0267139 A1* 9/2018 Park ..... H01Q 1/3233
2018/0267161 A1* 9/2018 Nagaishi ..... G01S 7/03
2018/0279466 A1* 9/2018 Shiozaki ..... H01Q 1/38
2018/0342797 A1* 11/2018 Pan ..... H01Q 1/38
2019/0245276 A1* 8/2019 Li ..... H01Q 1/38
2019/0364658 A1* 11/2019 Ammar ..... H05K 1/144
2020/0052390 A1* 2/2020 Ahmadloo ..... H01Q 21/065
2020/0076086 A1* 3/2020 Cheng ..... H01Q 9/42
2020/0168974 A1* 5/2020 Vosoogh ..... H01P 1/2005
2020/0220273 A1* 7/2020 Ahmadloo ..... H01Q 21/0043
2020/0335860 A1* 10/2020 Hasegawa ..... H01Q 1/40
2020/0350694 A1* 11/2020 Goto ..... H01Q 21/0075
2021/0036394 A1* 2/2021 Trummer ..... H05K 1/115
2021/0242581 A1* 8/2021 Rossiter ..... H01P 1/2005
2022/0059937 A1* 2/2022 Kuo ..... H01Q 21/065
2022/0131258 A1* 4/2022 Eid ..... H01Q 1/248
2022/0151074 A1* 5/2022 Gupta ..... H01P 5/107
2022/0159826 A1* 5/2022 Yun ..... H01P 3/12

FOREIGN PATENT DOCUMENTS

JP H11-251833 A 9/1999
TW 201909483 A 3/2019

* cited by examiner

ANTENNA STRUCTURE WITH WIDE BEAMWIDTH

CROSS REFERENCE TO RELATED APPLICATIONS

This Application claims priority of Taiwan Patent Application No. 109147077 filed on Dec. 31, 2020, the entirety of which is incorporated by reference herein.

BACKGROUND OF THE INVENTION

Field of the Invention

The disclosure generally relates to an antenna structure, and more particularly, to an antenna structure with a wide beamwidth.

Description of the Related Art

With the evolution of autonomous driving technology, radar has become standard equipment in smart vehicles, and its use will only increase in the future.

An antenna is an indispensable element of radar equipment. If the beamwidth of an antenna used for signal reception and transmission is insufficient, the detectable viewing angle of the radar will decrease, and more radar units are required to cover it. Therefore, it is a critical challenge for antenna designers to design an antenna element with a relatively wide beamwidth.

BRIEF SUMMARY OF THE INVENTION

In an exemplary embodiment, the invention is directed to an antenna structure with a wide beamwidth. The antenna structure for covering an operation frequency band includes a dielectric substrate, a ground plane, a first radiation element, a plurality of first conductive via elements, and a first feeding connection element. The dielectric substrate has a first surface and a second surface which are opposite to each other. The ground plane is disposed on the second surface of the dielectric substrate. The first radiation element is disposed on the first surface of the dielectric substrate. A first notch is formed on the first radiation element. The first conductive via elements penetrate the dielectric substrate. The first conductive via elements are coupled between the first radiation element and the ground plane. The first feeding connection element is coupled to the first radiation element. The first feeding connection element extends into the first notch of the first radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
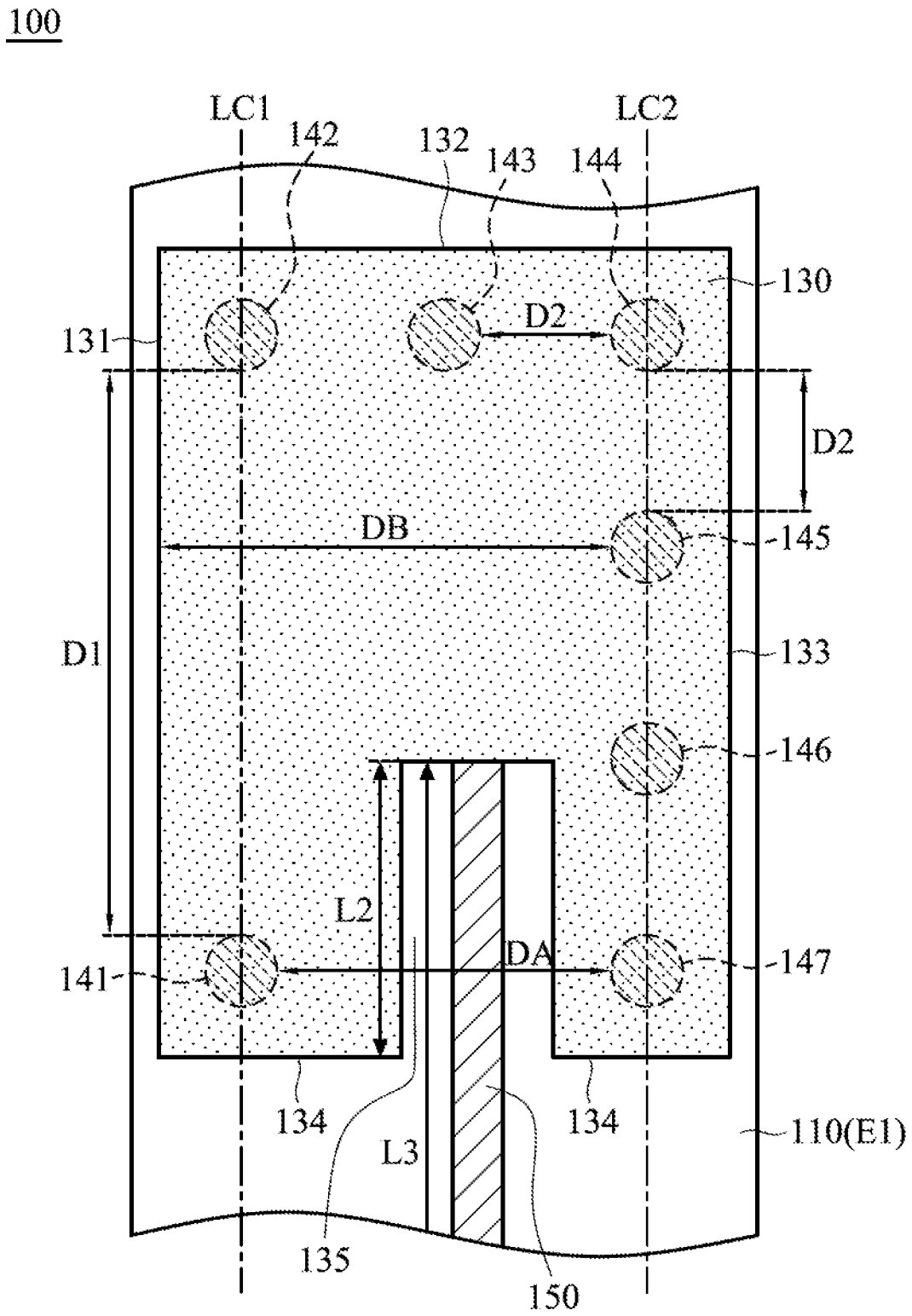
FIG. 1 is a top view of an antenna structure according to an embodiment of the invention.

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
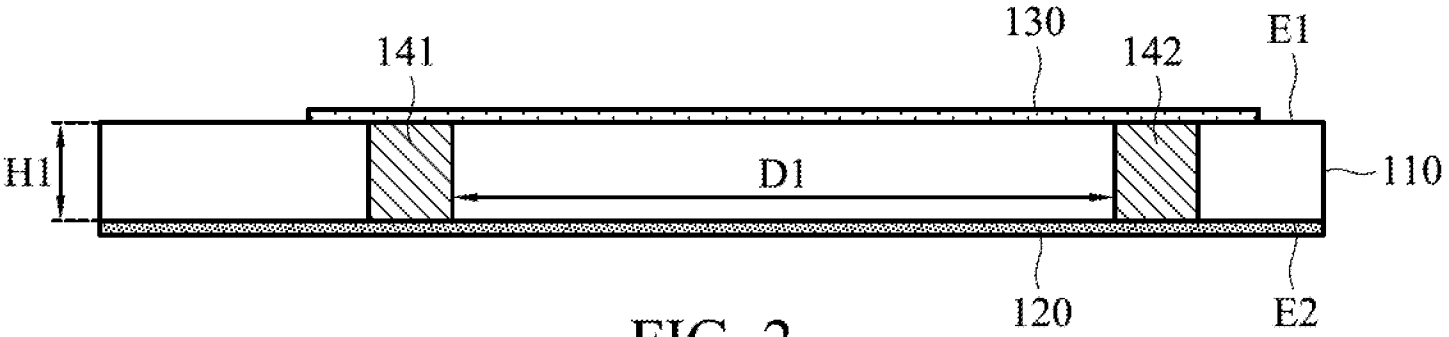
FIG. 2 is a sectional view of an antenna structure according to an embodiment of the invention.
Figure 3:
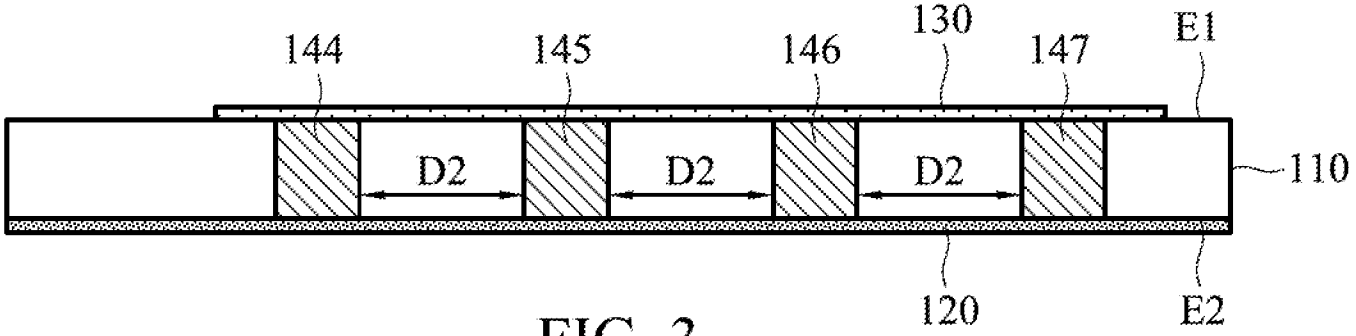
FIG. 3 is a sectional view of an antenna structure according to an embodiment of the invention.

FIG. 1 is a top view of an antenna structure 100 according to an embodiment of the invention. FIG. 2 is a sectional view of the antenna structure 100 according to an embodiment of the invention (along a first sectional line LC1 of FIG. 1). FIG. 3 is a sectional view of the antenna structure 100 according to an embodiment of the invention (along a second sectional line LC2 of FIG. 1). Please refer to FIG. 1, FIG. 2 and FIG. 3 together. The antenna structure 100 may be applied to the field of radar antennas, such as radar for vehicles, but it is not limited thereto. In the embodiment of FIG. 1, FIG. 2 and FIG. 3, the antenna structure 100 includes a dielectric substrate 110, a ground plane 120, a first radiation element 130, a plurality of first conductive via elements 141 to 147, and a first feeding connection element 150. The ground plane 120, the first radiation element 130, the first conductive via elements 141 to 147, and the first feeding connection element 150 may all be made of metal materials, such as copper, silver, aluminum, iron, or their alloys.

Depending on the specific application requirements, the dielectric substrate 110 may be an FR4 (Flame Retardant 4) substrate, a ceramic substrate, a Teflon substrate, a PCB (Printed Circuit Board) formed by the aforementioned substrates, or a FPC (Flexible Printed Circuit Board). The dielectric substrate 110 has a first surface E1 and a second surface E2 which are opposite to each other. The first radiation element 130 is disposed on the first surface E1 of the dielectric substrate 110. The ground plane 120 is disposed on the second surface E2 of the dielectric substrate 110. The ground plane 120 can provide a ground voltage. In some embodiments, the first radiation element 130 has a vertical projection on the second surface E2 of the dielectric substrate 110, and the whole vertical projection is inside the ground plane 120.

The first radiation element 130 may substantially have a relatively large rectangular shape with a first edge 131, a second edge 132, a third edge 133, and a fourth edge 134. A first notch 135 is formed on the first radiation element 130 and is positioned at the fourth edge 134. The first notch 135 may substantially have a relatively small rectangular shape. In the first radiation element 130, the third edge 133 is opposite to the first edge 131, and the fourth edge 134 is opposite to the second edge 132. It should be understood that the specific position of the first notch 135 on the fourth edge 134 of the first radiation element 130 can be adjusted to meet different requirements.

The first conductive via elements 141 to 147 can penetrate the dielectric substrate 110. The first conductive via elements 141 to 147 are all coupled between the first radiation element 130 and the ground plane 120. A relatively long distance D1 is defined between the first conductive via elements 141 and 142, which are adjacent to the first edge 131 of the first radiation element 130. A relatively short distance D2 is defined between any two of the first conductive via elements 142, 143, 144, 145, 146 and 147, which are adjacent to the second edge 132 and third edge 133 of the first radiation element 130. A relatively median distance DA is defined between the first conductive via elements 141 and 147, which are adjacent to the fourth edge 134 of the first radiation element 130. In addition, a distance DB is defined between each of the first conductive via elements 144, 145, 146 and 147 and the first edge 131 of the first radiation element 130. It should be noted that the term "adjacent" or "close" throughout the disclosure means that the distance (or the space) between two corresponding elements is shorter than a predetermined distance (e.g., 5 mm or less), or it may mean that the two corresponding elements touch each other directly (i.e., the aforementioned distance or space between them is reduced to 0). Generally, the first conductive via elements 141 to 147 are arranged in a half-loop shape, whose open side faces the first edge 131 of the first radiation element 130. In alternative embodiments, the total number and the specific positions of the first conductive via elements 141 to 147 can be adjusted to meet different requirements.

The first feeding connection element 150 may substantially have a straight-line shape. One end of the first feeding connection element 150 is coupled to the first radiation element 130 and extends into the first notch 135. Another end of the first feeding connection element 150 is coupled to a signal source (not shown). For example, the signal source may be an RF (Radio Frequency) module for exciting the antenna structure 100. In alternative embodiments, the first feeding connection element 150 is further coupled through other radiation elements and other feeding connection elements to the signal source.

In some embodiments, the antenna structure 100 can cover an operation frequency band from 76 GHz to 81 GHz. Accordingly, the antenna structure 100 can support at least the wideband operation of mmWave (Millimeter Wave) of radar for vehicles. According to practical measurements, such a design can help to increase the main beamwidth of the antenna structure 100 operating in the operation frequency band. Furthermore, the incorporation of the first conductive via elements 141 to 147 can limit the transmission directions of electromagnetic waves of the antenna structure 100, such that the electromagnetic waves are substantially transmitted toward the first edge 131 of the first radiation element 130. Specifically, the first conductive via elements 142, 143, 144, 145, 146 and 147, which are adjacent to the second edge 132 and the third edge 133 of the first radiation element 130, can prevent the electromagnetic waves in the operation frequency band from leaking outwardly. Conversely, the first conductive via elements 141 and 147, which are adjacent to the fourth edge 134 of the first radiation element 130, can allow the electromagnetic waves in the operation frequency band to be fed in through the open side therebetween. The first conductive via elements 141 and 142, which are adjacent to the first edge 131 of the first radiation element 130, can allow the electromagnetic waves in the operation frequency band to radiate outwardly through the open side therebetween.

In some embodiments, the element sizes and the element parameters of the antenna structure 100 are described as follows. The thickness H1 of the dielectric substrate 110 (i.e., the distance between the first surface E1 and the second surface E2) may be from 0.01 mm to 1 mm, such as about 0.127 mm. The dielectric constant of the dielectric substrate 110 may be from 2 to 5, such as about 2.89. The length L2 of the first notch 135 may be shorter than 0.25 wavelength (0.25λ) of the operation frequency band of the antenna structure 100. The distance D1 between any two of the first conductive via elements 141 and 142 adjacent to the first edge 131 of the first radiation element 130 may be from 0.45 to 0.55 wavelength (0.45λ~0.55λ) of the operation frequency band of the antenna structure 100. The distance D2 between any two of the first conductive via elements 142, 143, 144, 145, 146 and 147 adjacent to the second edge 132 and the third edge 133 of the first radiation element 130 may be shorter than or equal to 0.152 wavelength (0.152λ) of the operation frequency band of the antenna structure 100. The distance DA may be shorter than 0.4 wavelength (0.4λ) of the operation frequency band of the antenna structure 100. In addition, the distance DB may be from 0.375 to 0.625 wavelength (0.375λ~0.625λ) of the operation frequency band of the antenna structure 100. For example, if the distance D1 becomes longer, the distance DB will becomes shorter, and conversely, if the distance D1 becomes shorter, the distance DB will becomes longer. The length L3 of the first feeding connection element 150 may be from 0.9 to 1.1 wavelength (0.9λ~1.1λ) of the operation frequency band of the antenna structure 100. It should be understood that the above terms "wavelength" means the wavelength (λ) in free space. When a dielectric material is used (e.g., the dielectric substrate 110), the wavelength (λ) can be adjusted to a guided wavelength (λg) according to the effective dielectric constant between the dielectric substrate 110 and the free space. The above ranges of the element sizes and element parameters are calculated and obtained according to many experimental results, and they help to optimize the operation bandwidth and the impedance matching of the antenna structure 100.

Figure 4:
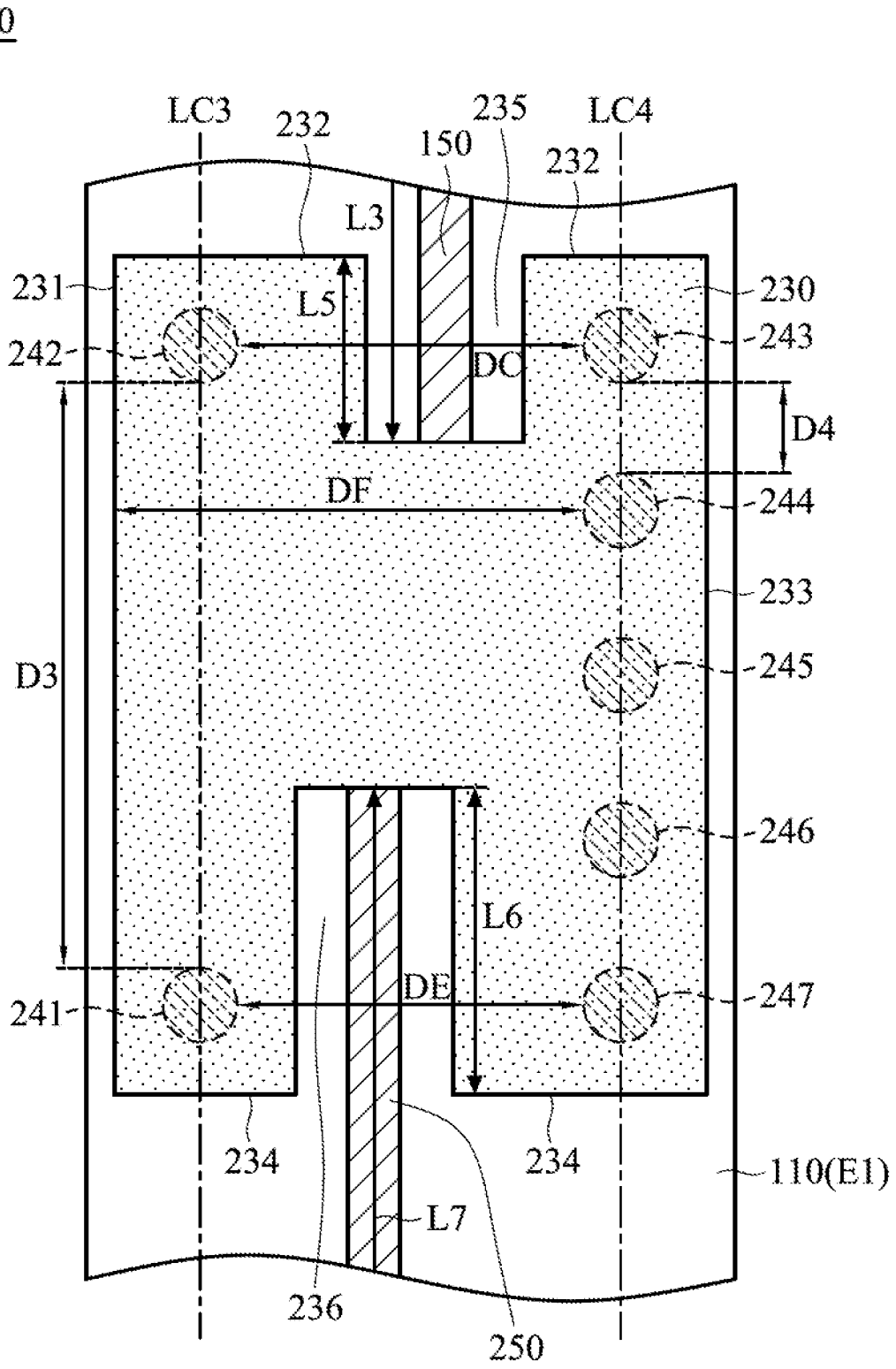
FIG. 4 is a top view of an antenna structure according to an embodiment of the invention.
Figure 5:
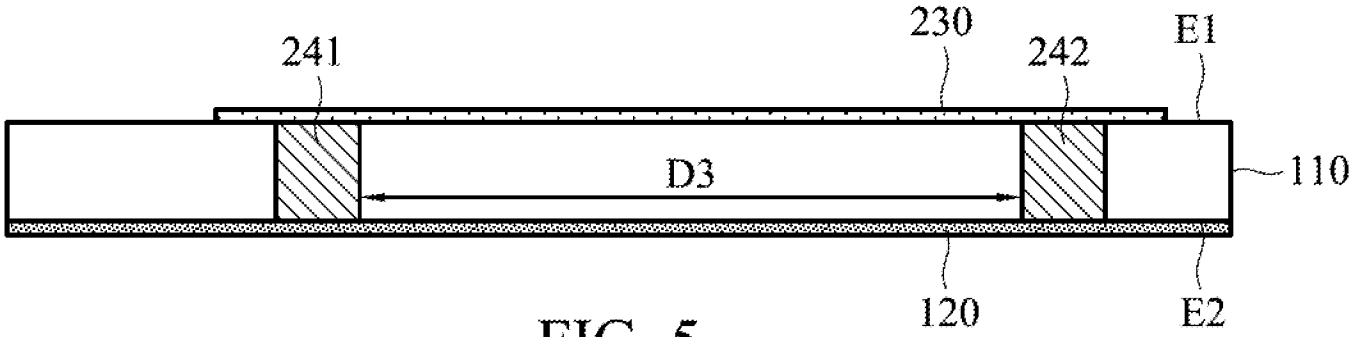
FIG. 5 is a sectional view of an antenna structure according to an embodiment of the invention.
Figure 6:
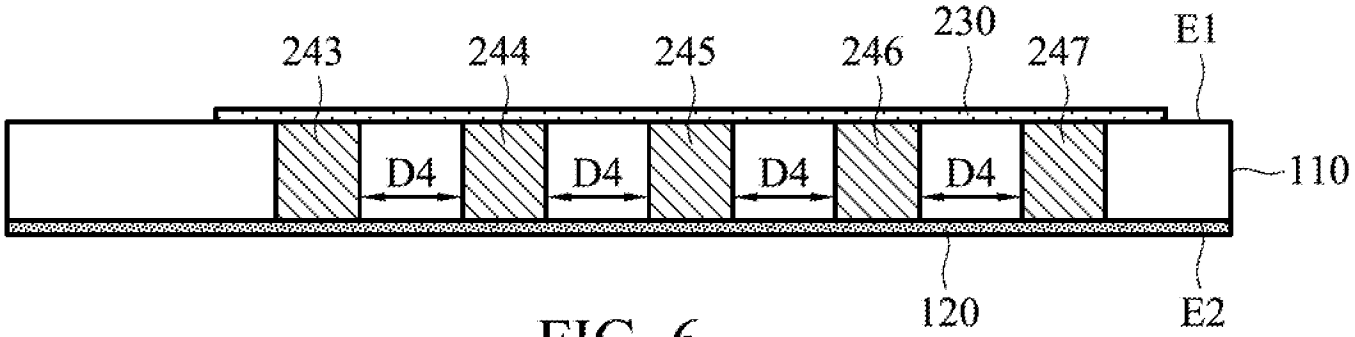
FIG. 6 is a sectional view of an antenna structure according to an embodiment of the invention.

FIG. 4 is a top view of an antenna structure 200 according to an embodiment of the invention. FIG. 5 is a sectional view of the antenna structure 200 according to an embodiment of the invention (along a third sectional line LC3 of FIG. 4). FIG. 6 is a sectional view of the antenna structure 200 according to an embodiment of the invention (along a fourth sectional line LC4 of FIG. 4). Please refer to FIG. 4, FIG. 5 and FIG. 6 together. In the embodiment of FIG. 4, FIG. 5 and FIG. 6, the antenna structure 200 further includes a second radiation element 230, a plurality of second conductive via elements 241 to 247, and a second feeding connection element 250. It should be understood that the antenna structure 200 also includes all of the components as displayed in FIG. 1, FIG. 2 and FIG. 3, and they will not be described again herein. In some embodiments, the second radiation element 230 has a vertical projection on the second surface E2 of the dielectric substrate 110, and the whole vertical projection is inside the ground plane 120.

The second radiation element 230 may substantially have a relatively large rectangular shape with a fifth edge 231, a sixth edge 232, a seventh edge 233, and an eighth edge 234. A second notch 235 is formed on the second radiation element 230 and is positioned at the sixth edge 232. The second notch 235 may substantially have a relatively small rectangular shape. In addition, a third notch 236 is also formed on the second radiation element 230 and is positioned at the eighth edge 234. The third notch 236 may substantially have a relatively small rectangular shape. In the second radiation element 230, the seventh edge 233 is opposite to the fifth edge 231, and the eighth edge 234 is opposite to the sixth edge 232. In some embodiments, the third notch 236 is closer to the fifth edge 231 of the second radiation element 230 than the second notch 235. However, the invention is not limited thereto. The specific positions of the second notch 235 and the third notch 236 on the sixth edge 232 and the eighth edge 234, respectively, of the second radiation element 230 can be adjusted to meet different requirements. In alternative embodiments, the second notch 235 and the third notch 236 are the same distance from the fifth edge 231 of the second radiation element 230.

The second conductive via elements 241 to 247 can penetrate the dielectric substrate 110. The second conductive via elements 241 to 247 are all coupled between the second radiation element 230 and the ground plane 120. A relatively long distance D3 is defined between the second conductive via elements 241 and 242, which are adjacent to the fifth edge 231 of the second radiation element 230. A relatively short distance D4 is defined between any two of the second conductive via elements 243, 244, 245, 246 and 247, which are adjacent to the seventh edge 233 of the second radiation element 230. For example, the distance D3 may be at least three times the distance D4, but they are not limited thereto. A relatively median distance DC is defined between the second conductive via elements 242 and 243, which are adjacent to the sixth edge 232 of the second radiation element 230. A relatively median distance DE is defined between the second conductive via elements 241 and 247, which are adjacent to the eighth edge 234 of the second radiation element 230. Furthermore, a distance DF is defined between each of the second conductive via elements 243, 244, 245, 246 and 247 and the fifth edge 231 of the second radiation element 230. Generally, the second conductive via elements 241 to 247 are arranged in a half-loop shape, whose open side faces the fifth edge 231 of the second radiation element 230. In alternative embodiments, the total number and the specific positions of the second conductive via elements 241 to 247 can be adjusted to meet different requirements.

In some embodiments, another end of the first feeding connection element 150 is further coupled to the second radiation element 230, and another end of the first feeding connection element 150 further extends into the second notch 235 of the second radiation element 230. The second feeding connection element 250 may substantially have a straight-line shape. Specifically, one end of the second feeding connection element 250 is coupled to the second radiation element 230 and extends into the third notch 236. Another end of the second feeding connection element 250 is coupled to the aforementioned signal source. In alternative embodiments, the second feeding connection element 250 is further coupled through other radiation elements and other feeding connection elements to the signal source. In some embodiments, the coupling positions of the first feeding connection element 150 and the second feeding connection element 250 are adjustable according to the requirements of impedance matching and power distribution. For example, the first feeding connection element 150 and the second feeding connection element 250 may be symmetrically arranged, or may be arranged in the same straight line.

In some embodiments, the antenna structure 200 can cover an operation frequency band from 76 GHz to 81 GHz. Accordingly, the antenna structure 200 can support at least the wideband operation of mmWave of radar for vehicles. According to practical measurements, such a design using both the first radiation element 130 and the second radiation element 230 can reduce the main beamwidth of the antenna structure 200 operating in the operation frequency band (referring to the measurement of FIG. 7 on the XZ-plane), and can also increase the radiation gain of the antenna structure 200 in the operation frequency band. On the other hand, the incorporation of the second conductive via elements 241 to 247 can limit the transmission directions of electromagnetic waves of the antenna structure 200, such that the electromagnetic waves are substantially transmitted toward the fifth edge 231 of the second radiation element 230. Specifically, the second conductive via elements 243, 244, 245, 246 and 247, which are adjacent to the seventh edge 233 of the second radiation element 230, can prevent the electromagnetic waves in the operation frequency band from leaking outwardly. Conversely, the second conductive via elements 241 and 247, which are adjacent to the eighth edge 234 of the second radiation element 230, can allow the electromagnetic waves in the operation frequency band to be fed in through the open side therebetween. The second conductive via elements 242 and 243, which are adjacent to the sixth edge 232 of the second radiation element 230, can allow the electromagnetic waves in the operation frequency band to be fed out through the open side therebetween. The second conductive via elements 241 and 242, which are adjacent to the fifth edge 231 of the second radiation element 230, can allow the electromagnetic waves in the operation frequency band to radiate outwardly through the open side therebetween.

In some embodiments, the element sizes and the element parameters of the antenna structure 200 are described as follows. The length L5 of the second notch 235 may be shorter than 0.25 wavelength (0.25λ) of the operation frequency band of the antenna structure 200. The length L6 of the third notch 236 may be shorter than 0.25 wavelength (0.25λ) of the operation frequency band of the antenna structure 200. The distance D3 between any two of the second conductive via elements 241 and 242 adjacent to the fifth edge 231 of the second radiation element 230 may be from 0.45 to 0.55 wavelength (0.45λ~0.55λ) of the operation frequency band of the antenna structure 200. The distance D4 between any two of the second conductive via elements 243, 244, 245, 246 and 247 adjacent to the seventh edge 233 of the second radiation element 230 may be shorter than or equal to 0.152 wavelength (0.152λ) of the operation frequency band of the antenna structure 200. The length L7 of the second feeding connection element 250 may be from 0.9 to 1.1 wavelength (0.9λ~1.1λ) of the operation frequency band of the antenna structure 200. Each of the distances DC and DE may be shorter than 0.4 wavelength (0.4λ) of the operation frequency band of the antenna structure 200. In addition, the distance DF may be from 0.375 to 0.625 wavelength (0.375λ~0.625λ) of the operation frequency band of the antenna structure 200. For example, if the distance D3 becomes longer, the distance DF will becomes shorter, and conversely, if the distance D3 becomes shorter, the distance DF will becomes longer. It should be understood that the above terms "wavelength" means the wavelength (λ) in free space. When a dielectric material is used (e.g., the dielectric substrate 110), the wavelength (λ) can be adjusted to a guided wavelength (λg) according to the effective dielectric constant between the dielectric substrate 110 and the free space. The above ranges of the element sizes and element parameters are calculated and obtained according to many experimental results, and they help to optimize the operation bandwidth and the impedance matching of the antenna structure 200.

Figure 7:
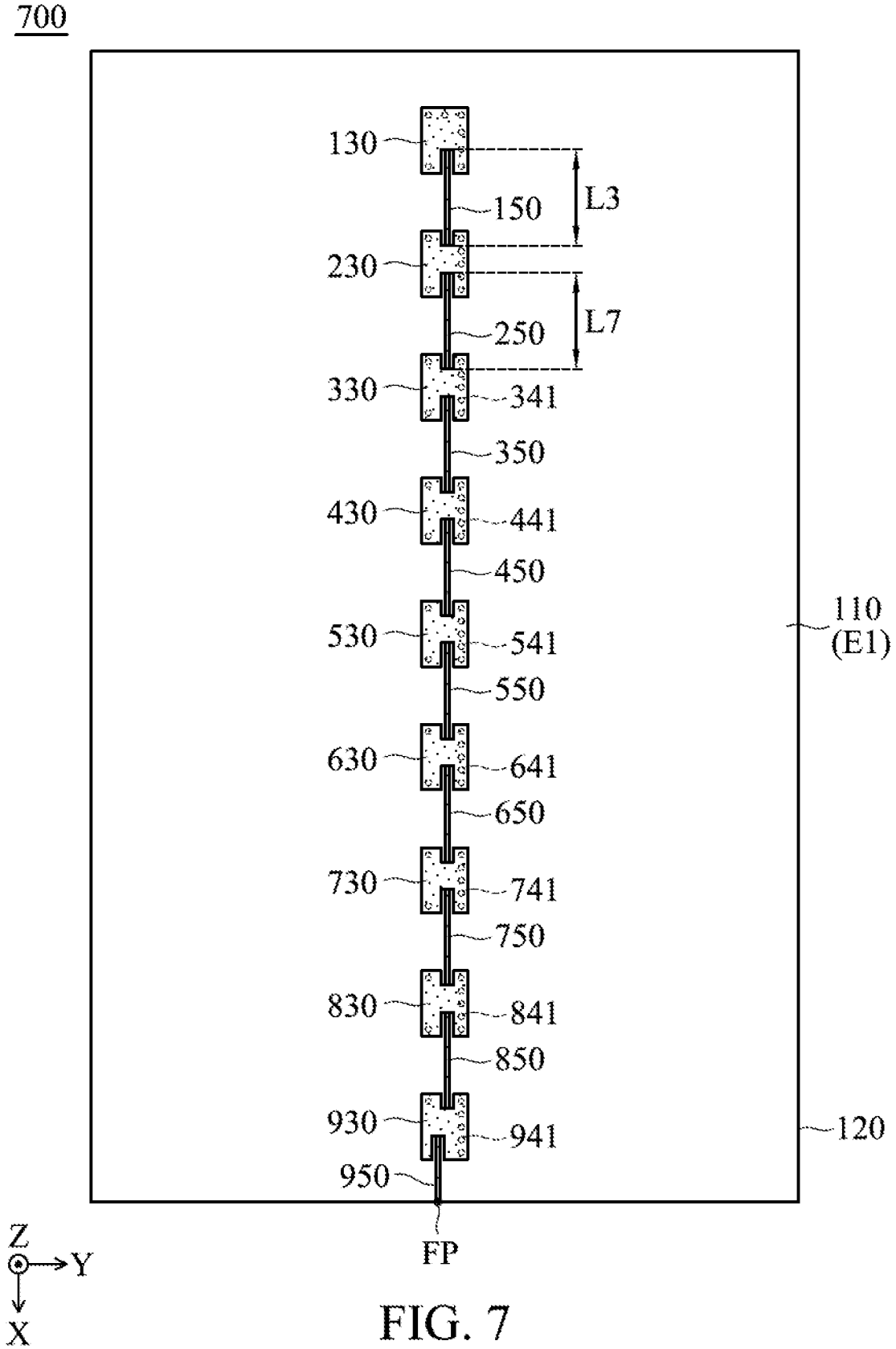
FIG. 7 is a top view of an antenna structure according to an embodiment of the invention.

FIG. 7 is a top view of an antenna structure 700 according to an embodiment of the invention. In the embodiment of FIG. 7, the antenna structure 700 further includes a third radiation element 330, a plurality of third conductive via elements 341, a third feeding connection element 350, a fourth radiation element 430, a plurality of fourth conductive via elements 441, a fourth feeding connection element 450, a fifth radiation element 530, a plurality of fifth conductive via elements 541, a fifth feeding connection element 550, a sixth radiation element 630, a plurality of sixth conductive via elements 641, a sixth feeding connection element 650, a seventh radiation element 730, a plurality of seventh conductive via elements 741, a seventh feeding connection element 750, an eighth radiation element 830, a plurality of eighth conductive via elements 841, an eighth feeding connection element 850, a ninth radiation element 930, a plurality of ninth conductive via elements 941, and a ninth feeding connection element 950. The ninth feeding connection element 950 has a feeding point FP, which may be coupled to the aforementioned signal source. Moreover, the structural features and connections of the third radiation element 330, the third conductive via elements 341, the third feeding connection element 350, the fourth radiation element 430, the fourth conductive via elements 441, the fourth feeding connection element 450, the fifth radiation element 530, the fifth conductive via elements 541, the fifth feeding connection element 550, the sixth radiation element 630, the sixth conductive via elements 641, the sixth feeding connection element 650, the seventh radiation element 730, the seventh conductive via elements 741, the seventh feeding connection element 750, the eighth radiation element 830, the eighth conductive via elements 841, the eighth feeding connection element 850, the ninth radiation element 930, the ninth conductive via elements 941, and the ninth feeding connection element 950 are substantially similar to those described in the embodiments of FIG. 4, FIG. 5 and FIG. 6. It should be understood that the antenna structure 700 also includes all of the components of FIGS. 1 to 6, and they will not be described again herein.

Figure 8:
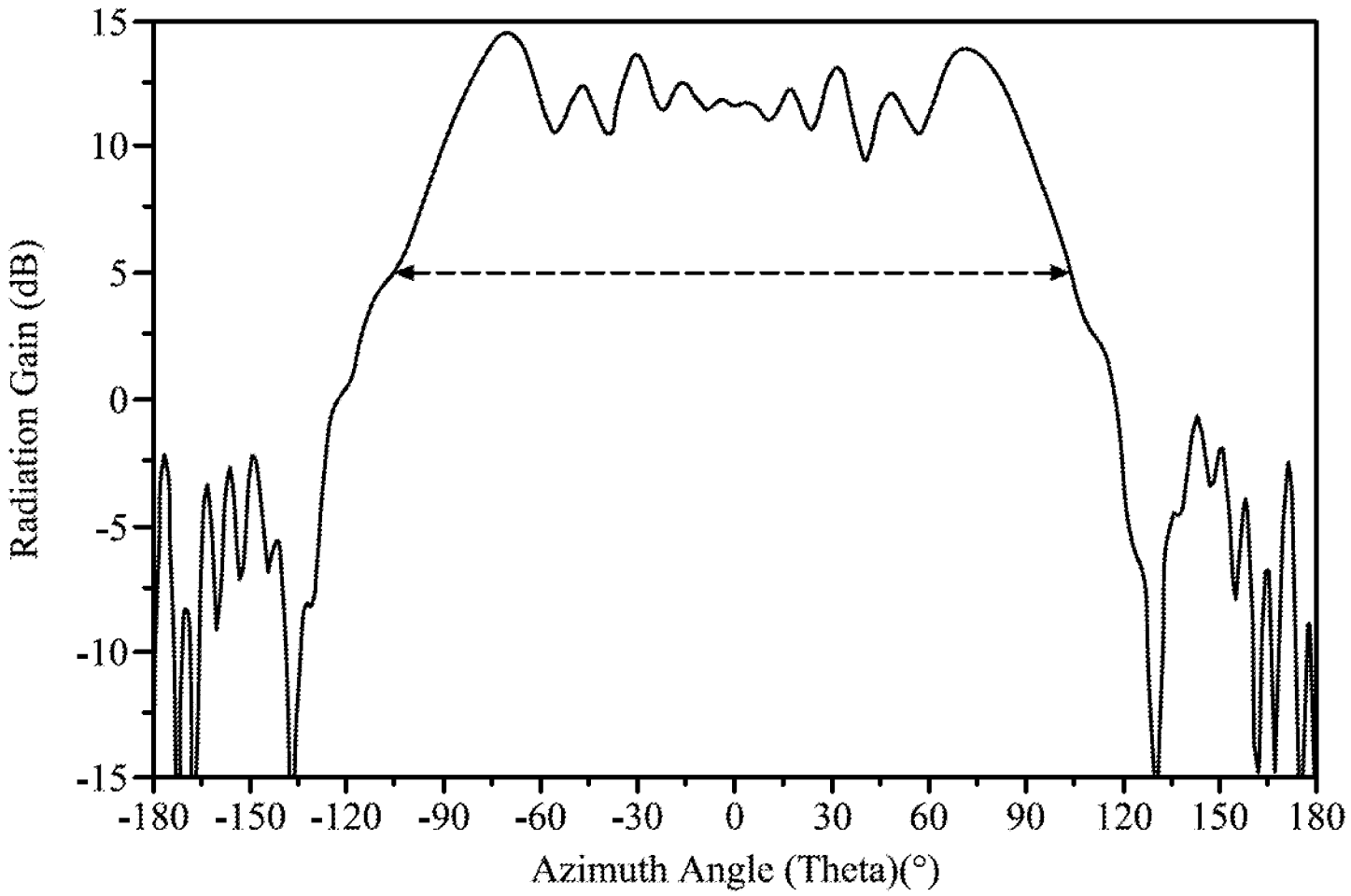
FIG. 8 is a radiation pattern of an antenna structure according to an embodiment of the invention.

FIG. 8 is a radiation pattern of the antenna structure 700 according to an embodiment of the invention (measured along the YZ-plane). The horizontal axis represents the azimuth angle (Theta) (degrees), and the vertical axis represents the radiation gain (dB). According to the measurement of FIG. 8, the 10 dB-beamwidth of the antenna structure 700 can achieve 180 degrees or more, and it can meet the requirements of practical applications of radar for vehicles. It should be understood that the corresponding radiation gain can be further increased if more radiation elements, more conductive via elements, and more feeding connection elements are added to the antenna structure 700.

Figure 9:
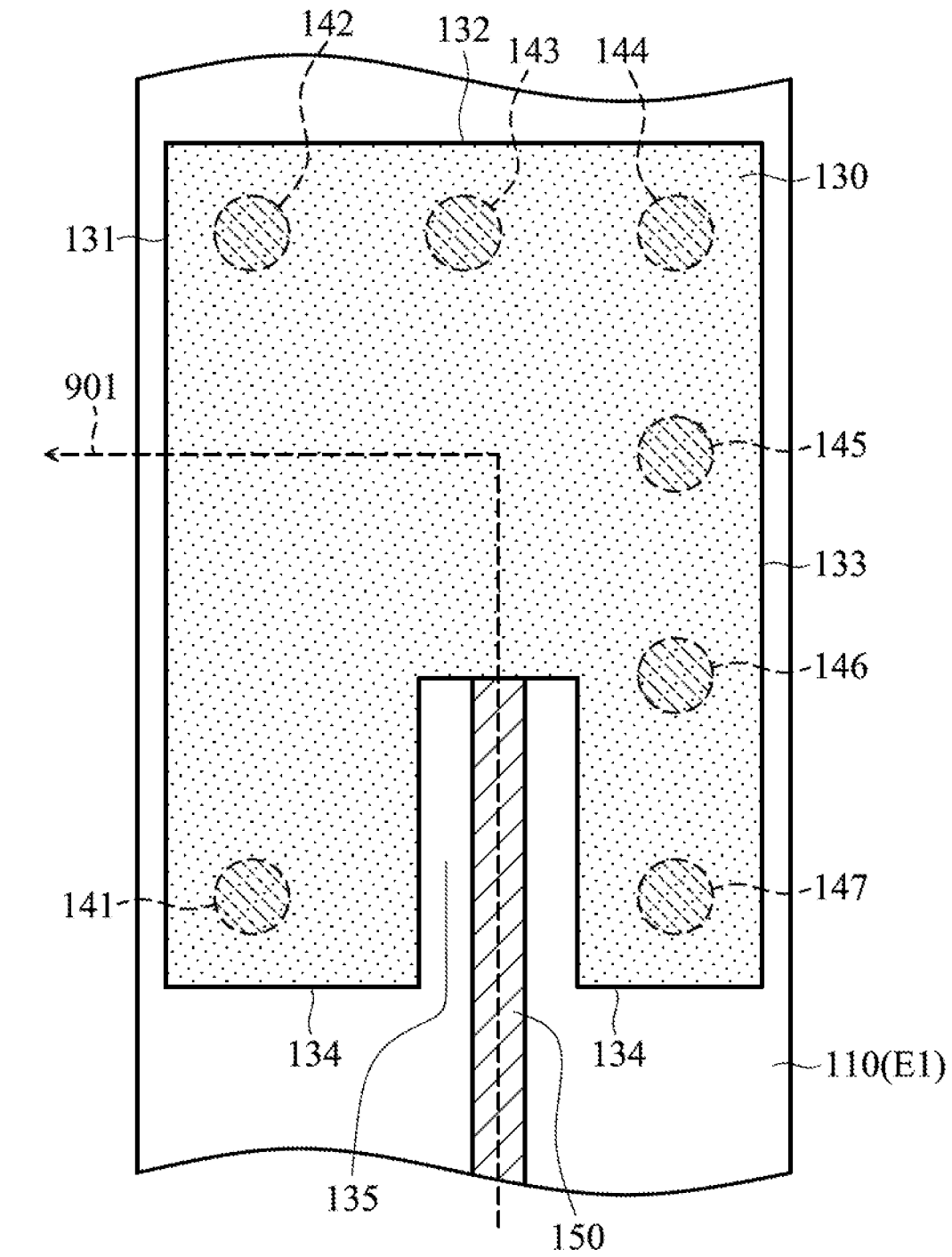
FIG. 9 is a diagram of energy transmission of a first radiation element according to an embodiment of the invention.

FIG. 9 is a diagram of energy transmission of the first radiation element 130 according to an embodiment of the invention. According to the measurement of FIG. 9 (as indicated by a first energy path 901), the electromagnetic energy is entered from the first feeding connection element 150 and then outputted outwardly through the open side between the first conductive via elements 141 and 142.

Figure 10:
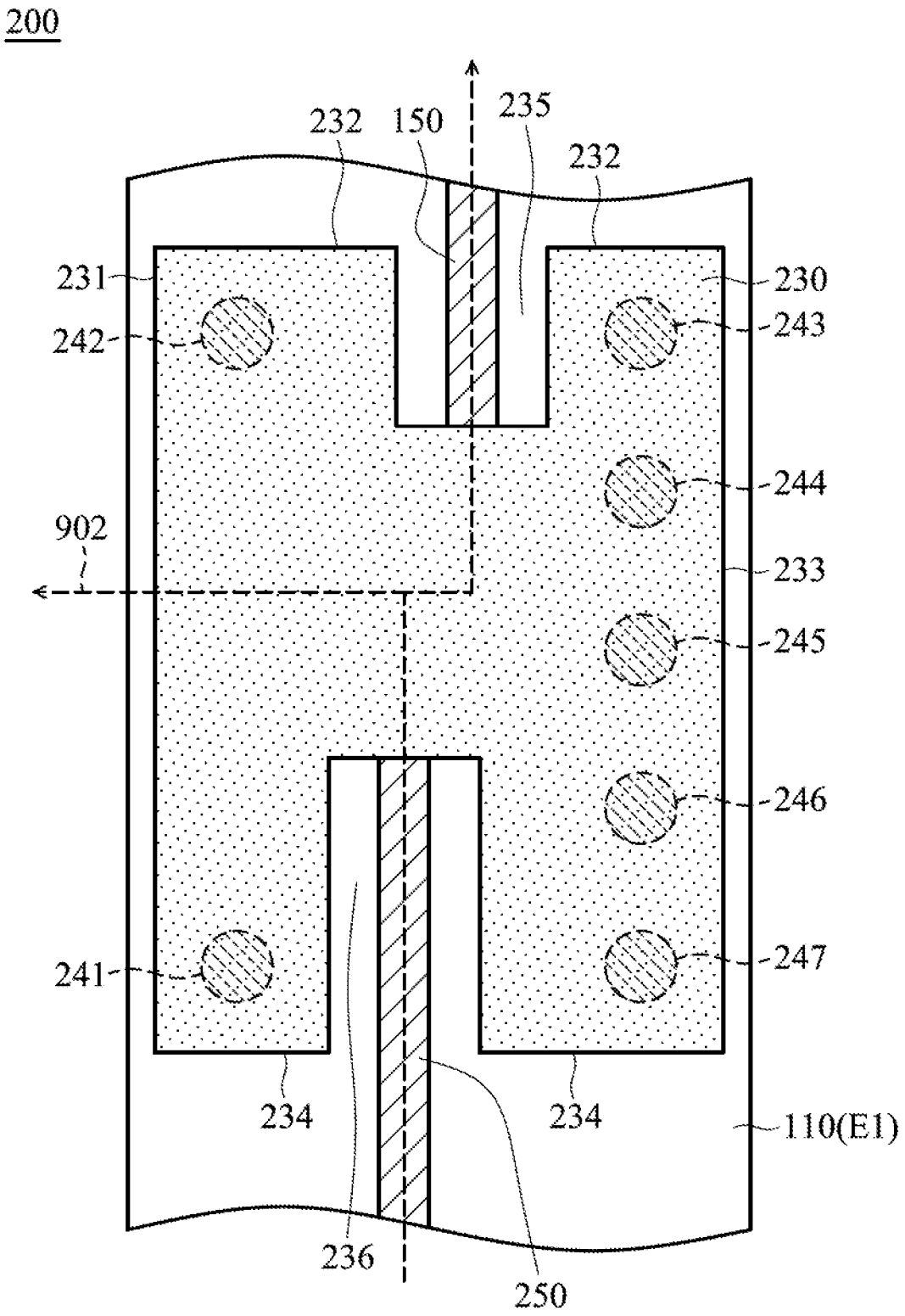
FIG. 10 is a diagram of energy transmission of a second radiation element according to an embodiment of the invention.

FIG. 10 is a diagram of energy transmission of the second radiation element 230 according to an embodiment of the invention. According to the measurement of FIG. 10 (as indicated by a second energy path 902), the electromagnetic energy is entered from the second feeding connection element 250. Next, a portion of the electromagnetic energy is outputted outwardly through the open side between the second conductive via elements 241 and 242, and another portion of the electromagnetic energy is outputted through the first feeding connection element 150 to the first radiation element 130.

Figure 11:
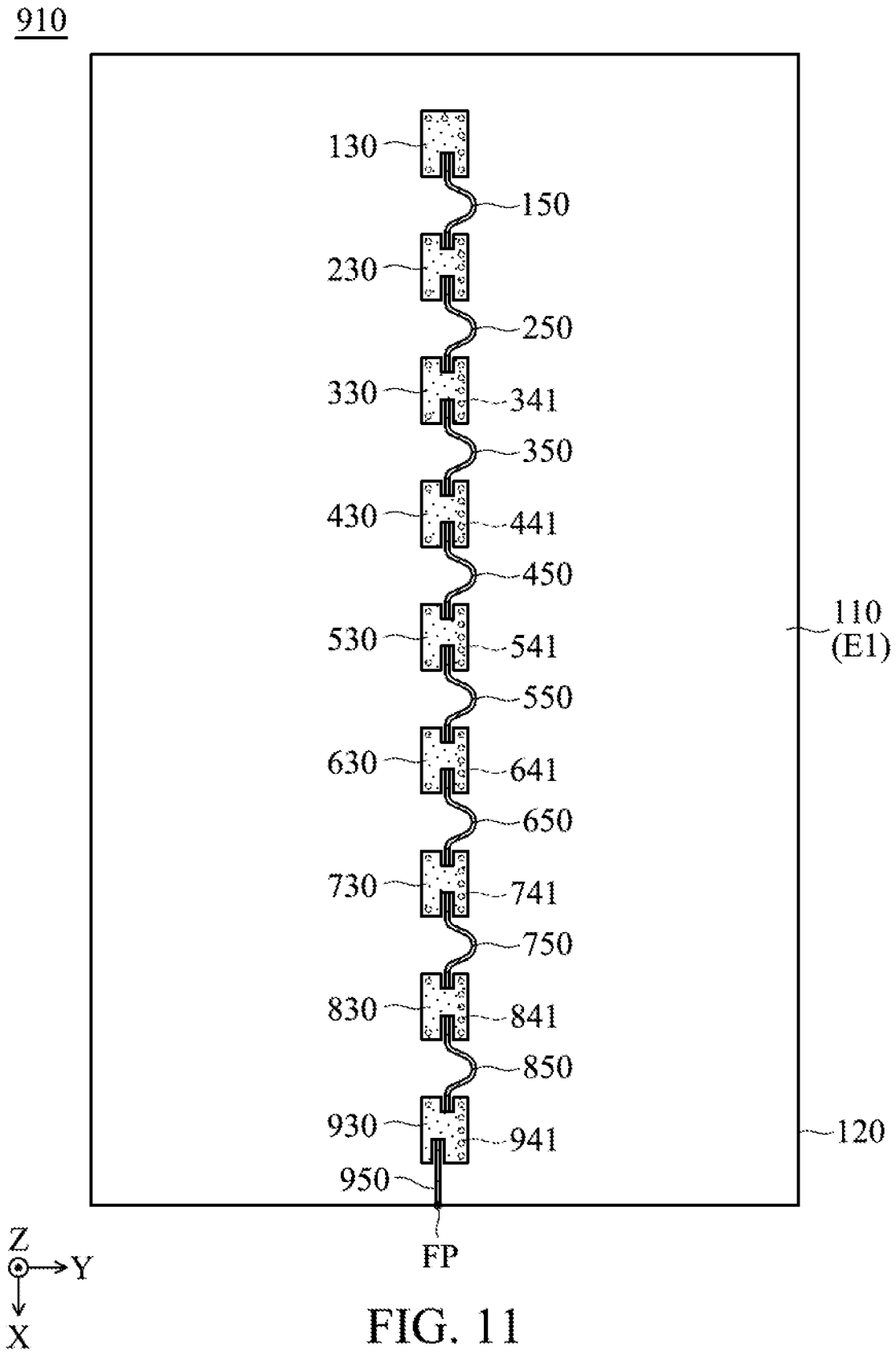
FIG. 11 is a top view of an antenna structure according to an embodiment of the invention.

FIG. 11 is a top view of an antenna structure 910 according to an embodiment of the invention. FIG. 11 is similar to FIG. 7. The difference between the two embodiments is that the first feeding connection element 150, the second feeding connection element 250, the third feeding connection element 350, the fourth feeding connection element 450, the fifth feeding connection element 550, the sixth feeding connection element 650, the seventh feeding connection element 750, the eighth feeding connection element 850, and the ninth feeding connection element 950 of the antenna structure 910 of FIG. 11 are adjusted to have meandering shapes, such as U-shapes or W-shapes in response to different requirements. According to practical measurements, such a design can minimize the total size of the antenna structure 910, such that more radiation elements can be added into the limited space.

Figure 12:
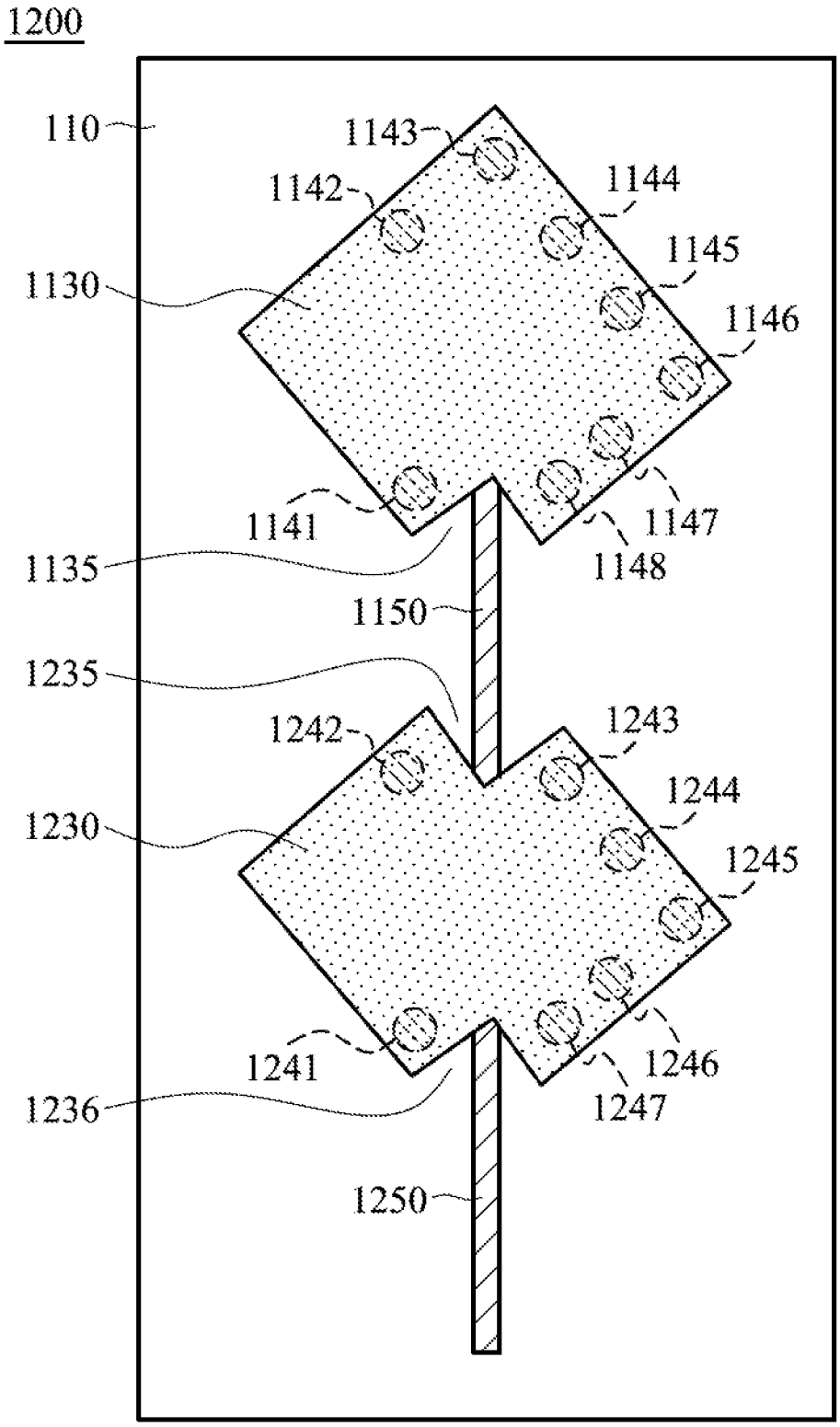
FIG. 12 is a top view of an antenna structure according to an embodiment of the invention.

FIG. 12 is a top view of an antenna structure 1200 according to an embodiment of the invention. FIG. 12 is similar to FIG. 1 and FIG. 4. In the embodiment of FIG. 12, the antenna structure 1200 includes a dielectric substrate 110, a ground plane 120 (not shown), a first radiation element 1130, a plurality of first conductive via elements 1141 to 1148, a first feeding connection element 1150, a second radiation element 1230, a plurality of second conductive via elements 1241 to 1247, and a second feeding connection element 1250. The first radiation element 1130 may substantially have a diamond shape with a first notch 1135. The first conductive via elements 1141 to 1148 can penetrate the dielectric substrate 110. The first conductive via elements 1141 to 1148 are all coupled between the first radiation element 1130 and the ground plane 120. A relatively long distance is defined between the first conductive via elements 1141 and 1142. The second radiation element 1230 may substantially have another diamond shape with a second notch 1235 and a third notch 1236. The second conductive via elements 1241 to 1247 can penetrate the dielectric substrate 110. The second conductive via elements 1241 to 1247 are all coupled between the second radiation element 1230 and the ground plane 120. A relatively long distance is defined between the second conductive via elements 1241 and 1242. For example, each of the first notch 1135, the second notch 1235, and the third notch 1236 may substantially have a relatively small rectangular shape or a relatively small diamond shape, but it is not limited thereto. Other features of the antenna structure 1200 of FIG. 12 are similar to those of the antenna structures 100 and 200 of FIG. 1 and FIG. 4. Therefore, these embodiments can achieve similar levels of performance.

Figure 13:
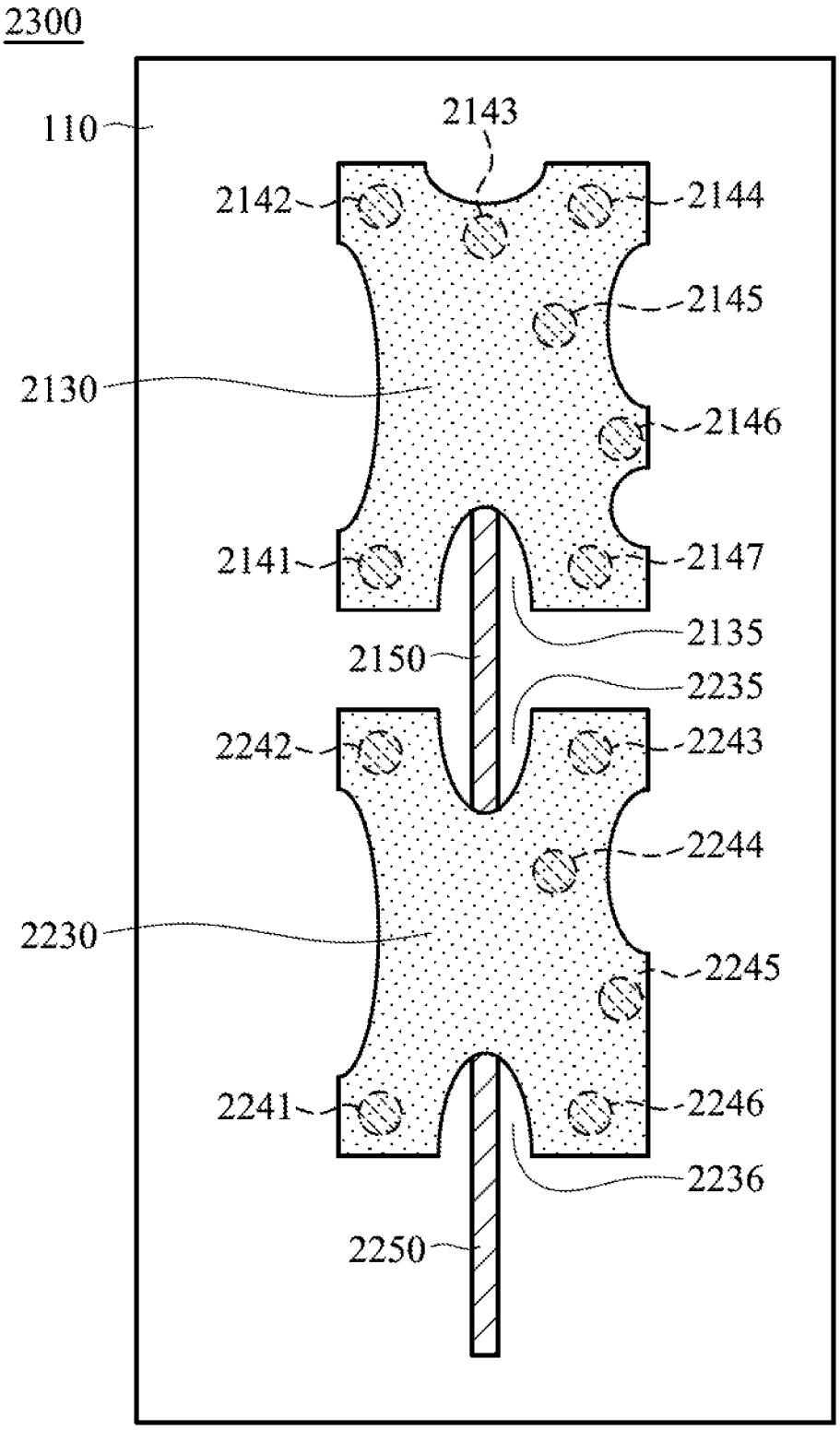
FIG. 13 is a top view of an antenna structure according to an embodiment of the invention.

FIG. 13 is a top view of an antenna structure 2300 according to an embodiment of the invention. FIG. 13 is similar to FIG. 1 and FIG. 4. In the embodiment of FIG. 13, the antenna structure 2300 includes a dielectric substrate 110, a ground plane 120 (not shown), a first radiation element 2130, a plurality of first conductive via elements 2141 to 2147, a first feeding connection element 2150, a second radiation element 2230, a plurality of second conductive via elements 2241 to 2246, and a second feeding connection element 2250. The first radiation element 2130 may substantially have an irregular shape with a first notch 2135. The first conductive via elements 2141 to 2147 can penetrate the dielectric substrate 110. The first conductive via elements 2141 to 2147 are all coupled between the first radiation element 2130 and the ground plane 120. A relatively long distance is defined between the first conductive via elements 2141 and 2142. The second radiation element 2230 may substantially have another irregular shape with a second notch 2235 and a third notch 2236. The second conductive via elements 2241 to 2246 can penetrate the dielectric substrate 110. The second conductive via elements 2241 to 2246 are all coupled between the second radiation element 2230 and the ground plane 120. A relatively long distance is defined between the second conductive via elements 2241 and 2242. For example, each of the first notch 2135, the second notch 2235, and the third notch 2236 may substantially have a relatively small semi-elliptical shape, but it is not limited thereto. Other features of the antenna structure 2300 of FIG. 13 are similar to those of the antenna structures 100 and 200 of FIG. 1 and FIG. 4. Therefore, these embodiments can achieve similar levels of performance.

The invention proposes a novel antenna structure. In comparison to the conventional design, the invention has at least the advantages of small size, wide bandwidth, low manufacturing cost, and large beamwidth, and therefore it is suitable for application in a variety of antennas.

Note that the above element sizes, element shapes, element parameters, and frequency ranges are not limitations of the invention. An antenna designer can fine-tune these settings or values to meet different requirements. It should be understood that the antenna structure of the invention is not limited to the configurations of FIGS. 1-13. The invention may include any one or more features of any one or more embodiments of FIGS. 1-13. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure with a wide beamwidth for covering an operation frequency band, comprising:

a dielectric substrate, having a first surface and a second surface opposite to each other;

a ground plane, disposed on the second surface of the dielectric substrate;

a first radiation element, disposed on the first surface of the dielectric substrate, wherein a first notch is formed on the first radiation element;

a plurality of first conductive via elements, penetrating the dielectric substrate, wherein the first conductive via elements are coupled between the first radiation element and the ground plane; and a first feeding connection element, coupled to the first radiation element, wherein the first feeding connection element extends into the first notch of the first radiation element;

wherein the first radiation element has a first edge, a second edge, a third edge, and a fourth edge, and the first notch is positioned at the fourth edge;

wherein a distance between any two first conductive via elements adjacent to the first edge of the first radiation element is from 0.45 to 0.55 wavelength of the operation frequency band.

2. The antenna structure as claimed in claim 1, wherein the operation frequency band is from 76 GHz to 81 GHz.

3. The antenna structure as claimed in claim 1, wherein a length of the first notch of the first radiation element is shorter than 0.25 wavelength of the operation frequency band.

4. The antenna structure as claimed in claim 1, wherein a distance between any two first conductive via elements adjacent to the fourth edge of the first radiation element is shorter than 0.4 wavelength of the operation frequency band.

5. The antenna structure as claimed in claim 1, wherein a distance between any two first conductive via elements adjacent to the third edge of the first radiation element is shorter than or equal to 0.152 wavelength of the operation frequency band.

6. The antenna structure as claimed in claim 1, wherein a length of the first feeding connection element is from 0.9 to 1.1 wavelength of the operation frequency band.

7. The antenna structure as claimed in claim 1, further comprising:

a second radiation element, disposed on the first surface of the dielectric substrate, wherein a second notch and a third notch are formed on the second radiation element.

8. The antenna structure as claimed in claim 7, further comprising:

a plurality of second conductive via elements, penetrating the dielectric substrate, wherein the second conductive via elements are coupled between the second radiation element and the ground plane.

9. The antenna structure as claimed in claim 8, further comprising:

a second feeding connection element, coupled to the second radiation element, wherein the second feeding connection element extends into the third notch of the second radiation element.

10. The antenna structure as claimed in claim 7, wherein the first feeding connection element is further coupled to the second radiation element, and the first feeding connection element further extends into the second notch of the second radiation element.

11. The antenna structure as claimed in claim 8, wherein the second radiation element has a fifth edge, a sixth edge, a seventh edge, and an eighth edge, the second notch is positioned at the sixth edge, and the third notch is positioned at the eighth edge.

12. The antenna structure as claimed in claim 7, wherein a length of each of the second notch and the third notch of the second radiation element is shorter than 0.25 wavelength of the operation frequency band.

13. The antenna structure as claimed in claim 11, wherein a distance between any two second conductive via elements adjacent to the fifth edge of the second radiation element is from 0.45 to 0.55 wavelength of the operation frequency band.

14. The antenna structure as claimed in claim 11, wherein a distance between any two second conductive via elements adjacent to the sixth edge or the eighth edge of the second radiation element is shorter than 0.4 wavelength of the operation frequency band.

15. The antenna structure as claimed in claim 11, wherein a distance between any two second conductive via elements adjacent to the seventh edge of the second radiation element is shorter than or equal to 0.152 wavelength of the operation frequency band.

16. The antenna structure as claimed in claim 9, wherein a length of the second feeding connection element is from 0.9 to 1.1 wavelength of the operation frequency band.

* * * * *